US010502149B2

(12) United States Patent
Nakano

(10) Patent No.: US 10,502,149 B2
(45) Date of Patent: Dec. 10, 2019

(54) METHOD FOR OPERATING ENGINE IN INTERMITTENT COMBUSTION MODE AND ENGINE CONTROL DEVICE

(71) Applicant: TOYOTA JIDOSHA KABUSHIKI KAISHA, Toyota-shi, Aichi-ken (JP)

(72) Inventor: Tomohiro Nakano, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 15 days.

(21) Appl. No.: 15/924,948

(22) Filed: Mar. 19, 2018

(65) Prior Publication Data

US 2018/0313281 A1 Nov. 1, 2018

(30) Foreign Application Priority Data

Apr. 28, 2017 (JP) ..... 2017-089475

(51) Int. Cl.

| | |
|---|---|
| ***F02D 1/00*** | (2006.01) |
| ***F02D 41/00*** | (2006.01) |
| ***F02D 41/30*** | (2006.01) |
| ***F02D 41/34*** | (2006.01) |
| *F02D 41/12* | (2006.01) |
| *F02D 37/02* | (2006.01) |

(52) U.S. Cl.

CPC ..... *F02D 41/0087* (2013.01); *F02D 41/0002* (2013.01); *F02D 41/307* (2013.01); *F02D 41/3058* (2013.01); *F02D 41/345* (2013.01); *F02D 37/02* (2013.01); *F02D 41/123* (2013.01); *F02D 2200/0404* (2013.01); *F02D 2200/1002* (2013.01); *F02D 2200/602* (2013.01); *F02D 2250/21* (2013.01); *F02D 2250/28* (2013.01)

(58) Field of Classification Search

CPC ..... F02D 1/02; F02D 17/02; F02D 41/0085; F02D 41/0087; F02D 41/3058; F02D 2009/0235

USPC ..... 123/319, 320, 325, 481, 198 F

See application file for complete search history.

(56) References Cited

U.S. PATENT DOCUMENTS

| | | | | |
|---|---|---|---|---|
| 7,577,511 | B1 | 8/2009 | Tripathi et al. | |
| 2013/0289853 | A1 | 10/2013 | Serrano | |
| 2014/0041630 | A1 | 2/2014 | Carlson et al. | |
| 2014/0090624 | A1 | 4/2014 | Verner | |
| 2018/0171880 | A1* | 6/2018 | Nakano | F02D 1/02 |
| 2018/0238248 | A1* | 8/2018 | Karnik | F02D 41/0087 |
| 2019/0048814 | A1* | 2/2019 | Nakano | F02D 41/0087 |
| 2019/0211761 | A1* | 7/2019 | Ranga | F02D 41/004 |

* cited by examiner

*Primary Examiner* — John Kwon

(74) *Attorney, Agent, or Firm* — Oliff PLC

(57) ABSTRACT

An intermittent combustion mode is executed while cyclically switching an intermittent firing pattern in such a manner that the skipped-cylinder interval is changed by one cylinder at a time. Furthermore, the intermittent firing pattern is switched in such a manner that the fired cylinder ratio in one cycle of switching of the intermittent firing pattern becomes equal to a target fired cylinder ratio. This suppresses the occurrence of vibration and noise having low frequencies that tend to disturb the occupant while limiting an increase in the rotational fluctuation of the engine.

16 Claims, 7 Drawing Sheets

Fig. 8

TABLE 2

| INTERMITTENT FIRING PATTERN | (●: FIRING, ▬ : SKIP) 1 | 2 | 3 | 4 | 5 | 6 |
|---|---|---|---|---|---|---|
| [1-1] | ● | ▬ | | | | |
| [2-1] | ● | ● | ▬ | | | |
| [3-1] | ● | ● | ● | ▬ | | |
| [4-1] | ● | ● | ● | ● | ▬ | |
| [5-1] | ● | ● | ● | ● | ● | ▬ |

Fig. 9

TABLE 3

| TARGET FIRED CYLINDER RATIO | CYLINDER NUMBER (●: FIRING, ▬ : SKIP) #1 | #3 | #4 | #2 | #1 | #3 | #4 | #2 | #1 | #3 | #4 | #2 | #1 | #3 | #4 | #2 | #1 | #3 | #4 | #2 | #1 | #3 | #4 | #2 | • • • |
|---|---|---|---|---|---|---|---|---|---|---|---|---|---|---|---|---|---|---|---|---|---|---|---|---|---|
| 1/2 (= 50%) | ● | ▬ | ● | ▬ | ● | ▬ | ● | ▬ | ● | ▬ | ● | ▬ | ● | ▬ | ● | ▬ | ● | ▬ | ● | ▬ | ● | ▬ | ● | ▬ | • • • |
| 2/3 (≒ 67%) | ● | ● | ▬ | ● | ● | ● | ▬ | ● | ● | ▬ | ● | ▬ | ● | ● | ▬ | ● | ● | ● | ▬ | ● | ● | ▬ | ● | ▬ | • • • |
| 3/4 (= 75%) | ● | ● | ● | ▬ | ● | ● | ● | ● | ▬ | ● | ● | ● | ▬ | ● | ● | ▬ | ● | ● | ● | ▬ | ● | ● | ● | ● | • • • |
| 4/5 (= 80%) | ● | ● | ● | ● | ▬ | ● | ● | ● | ● | ● | ▬ | ● | ● | ● | ● | ▬ | ● | ● | ● | ▬ | ● | ● | ● | ● | • • • |
| 1 (= 100%) | ● | ● | ● | ● | ● | ● | ● | ● | ● | ● | ● | ● | ● | ● | ● | ● | ● | ● | ● | ● | ● | ● | ● | ● | • • • |

Fig. 10

TABLE 5

| FIRED CYLINDER RATIO $\gamma$ | CYLINDER NUMBER (●: FIRING, ▬ : SKIP) #1 | #3 | #4 | #2 | #1 | #3 | #4 | #2 | #1 | #3 | #4 | #2 | #1 | #3 | #4 | #2 | #1 | #3 | #4 | #2 | #1 | #3 | #4 | #2 | • • • |
|---|---|---|---|---|---|---|---|---|---|---|---|---|---|---|---|---|---|---|---|---|---|---|---|---|---|
| 3/5 (= 60%) | ● | ▬ | ● | ● | ▬ | ● | ▬ | ● | ● | ▬ | ● | ▬ | ● | ● | ▬ | ● | ● | ▬ | ● | ▬ | ● | ▬ | ● | ● | • • • |
| 5/7 (≒ 71%) | ● | ● | ▬ | ● | ● | ● | ▬ | ● | ● | ▬ | ● | ● | ● | ▬ | ● | ● | ▬ | ● | ● | ● | ▬ | ● | ● | ▬ | • • • |
| 7/9 (≒ 78%) | ● | ● | ● | ▬ | ● | ● | ● | ● | ▬ | ● | ● | ● | ▬ | ● | ● | ● | ● | ▬ | ● | ● | ● | ▬ | ● | ● | • • • |
| 9/11 (≒ 82%) | ● | ● | ● | ● | ▬ | ● | ● | ● | ● | ● | ▬ | ● | ● | ● | ● | ▬ | ● | ● | ● | ● | ● | ▬ | ● | ● | • • • |

Fig. 11

TABLE 6

| INTERMITTENT FIRING PATTERN | (●: FIRING, ▬ : SKIP) 1 | 2 | 3 | 4 | 5 |
|---|---|---|---|---|---|
| [1-2] | ● | ▬ | ▬ | | |
| [1-3] | ● | ▬ | ▬ | ▬ | |
| [1-4] | ● | ▬ | ▬ | ▬ | ▬ |

Fig. 12

TABLE 8

| FIRED CYLINDER RATIO $\gamma$ | CYLINDER NUMBER (●: FIRING, ▬ : SKIP) #1 | #3 | #4 | #2 | #1 | #3 | #4 | #2 | #1 | #3 | #4 | #2 | #1 | #3 | #4 | #2 | #1 | #3 | #4 | #2 | #1 | #3 | #4 | #2 | • • • |
|---|---|---|---|---|---|---|---|---|---|---|---|---|---|---|---|---|---|---|---|---|---|---|---|---|---|
| 2/5 (= 40%) | ● | ▬ | ▬ | ● | ▬ | ● | ▬ | ▬ | ● | ▬ | ● | ▬ | ▬ | ● | ▬ | ● | ▬ | ▬ | ● | ▬ | ● | ▬ | ▬ | ● | • • • |
| 1/3 (≒ 33%) | ● | ▬ | ▬ | ● | ▬ | ● | ▬ | ▬ | ● | ▬ | ▬ | ▬ | ● | ▬ | ▬ | ● | ▬ | ● | ▬ | ▬ | ● | ▬ | ▬ | ▬ | • • • |
| 2/7 (≒ 29%) | ● | ▬ | ▬ | ▬ | ● | ▬ | ▬ | ● | ▬ | ▬ | ▬ | ● | ▬ | ▬ | ● | ▬ | ▬ | ▬ | ● | ▬ | ▬ | ● | ▬ | ▬ | • • • |
| 1/4 (= 25%) | ● | ▬ | ▬ | ▬ | ● | ▬ | ▬ | ● | ▬ | ▬ | ▬ | ● | ▬ | ▬ | ▬ | ▬ | ● | ▬ | ▬ | ▬ | ● | ▬ | ▬ | ● | • • • |

Fig. 13

TABLE 9

| FIRED CYLINDER RATIO $\gamma$ | CYLINDER NUMBER (●: FIRING, ▬ : SKIP) #1 | #3 | #4 | #2 | #1 | #3 | #4 | #2 | #1 | #3 | #4 | #2 | #1 | #3 | #4 | #2 | #1 | #3 | #4 | #2 | #1 | #3 | #4 | #2 | • • • |
|---|---|---|---|---|---|---|---|---|---|---|---|---|---|---|---|---|---|---|---|---|---|---|---|---|---|
| 1/2 (= 50%) | ● | ▬ | ● | ● | ▬ | ● | ▬ | ● | ▬ | ▬ | ● | ▬ | ● | ● | ▬ | ● | ▬ | ● | ▬ | ▬ | ● | ▬ | ● | ● | • • • |

Fig. 14

TABLE 10

| INTERMITTENT FIRING PATTERN | (●: FIRING, ▬ : SKIP) 1 | 2 | 3 | 4 | 5 | 6 |
|---|---|---|---|---|---|---|
| [2-2] | ● | ● | ▬ | ▬ | | |
| [3-2] | ● | ● | ● | ▬ | ▬ | |
| [4-2] | ● | ● | ● | ● | ▬ | ▬ |

METHOD FOR OPERATING ENGINE IN INTERMITTENT COMBUSTION MODE AND ENGINE CONTROL DEVICE

BACKGROUND

The present disclosure relates to a method for operating an engine in an intermittent combustion mode and an engine control device.

U.S. Pat. No. 7,577,511 discloses a method for executing an intermittent combustion mode in which combustion in cylinders is intermittently skipped. The publication discloses a method for adjusting the engine output by changing the ratio of fired cylinders γ [γ=the number of fired cylinders/(the number of fired cylinders+the number of skipped cylinders)] in the intermittent combustion mode.

In the above publication, the fired cylinder ratio is set to 6/8 (=75%) by executing the intermittent combustion mode with a pattern in which five cylinders are successively fired, one cylinder is skipped, one cylinder is fired, and then one cylinder is skipped. In this intermittent firing pattern, a period corresponding to five cylinders and a period corresponding to one cylinder exist as a skipped-cylinder interval. The skipped-cylinder interval is represented by the number of cylinders that are fired from when the combustion is skipped until another combustion is skipped.

In a period in which the skipped-cylinder interval is long, the generation amount of torque per unit time is increased. In a period in which the skipped-cylinder interval is short, the generation amount of torque per unit time is decreased. For this reason, if there are periods in which the skipped-cylinder intervals differ greatly in the intermittent firing pattern, the rotational fluctuation of the engine is increased.

In contrast, if the skipped-cylinder intervals are constant, the torque fluctuation caused by skipping the cylinders occurs in a certain cycle, which generates vibration and noise. Thus, vibration and noise having low frequencies that are likely to disturb the occupant may possibly occur.

SUMMARY

Accordingly, it is an objective of the present disclosure to provide a method for operating an engine in an intermittent combustion mode and an engine control device that suppresses the occurrence of vibration and noise having low frequencies that are likely to disturb an occupant while limiting an increase in the rotational fluctuation of the engine.

To achieve the foregoing objective, a first aspect of the present disclosure provides a method for operating an engine in an intermittent combustion mode in such a manner that a fired cylinder ratio of an engine becomes equal to a target fired cylinder ratio set based on an operating state of the engine by repeating an intermittent firing pattern in which n cylinders are successively fired, and then m cylinders are successively skipped, where n and m are variables of natural numbers. The method includes switching the intermittent firing pattern in such a manner that: one of n and m is set to a value equal to the value before switching the intermittent firing pattern; the other one of n and m is changed by only 1 from the value before switching the intermittent firing pattern; the switching of the intermittent firing pattern is performed cyclically so that, each time the switching of the intermittent firing pattern is performed a predetermined number of times, the intermittent firing pattern that is the same as the previous intermittent firing pattern appears; and the fired cylinder ratio in one cycle of switching of the intermittent firing pattern becomes equal to the target fired cylinder ratio.

To achieve the foregoing objective, a second aspect of the present disclosure provides an engine control device that includes a target fired-cylinder-ratio setting period, which sets a target fired cylinder ratio based on an operating state of an engine, and an intermittent combustion command section, which outputs a command signal that commands whether to fire or skip cylinders that are entering a combustion stroke. The intermittent combustion command section outputs the command signal by repeating an output pattern in which the combustion command section commands to successively fire n cylinders and then commands to successively skip firing in m cylinders, where n and m are variables of natural numbers. The intermittent combustion command section switches the intermittent firing pattern in such a manner that: one of n and m is set to a value equal to the value before switching the intermittent firing pattern; the other one of n and m is changed by only 1 from the value before switching the intermittent firing pattern; the switching of the output pattern is performed cyclically so that, each time the switching of the output pattern is performed a predetermined number of times, the output pattern that is the same as the previous output pattern appears; and a fired cylinder ratio in one cycle of switching of the output pattern becomes equal to the target fired cylinder ratio.

Other aspects and advantages of the disclosed embodiments will become apparent from the following description, taken in conjunction with the accompanying drawings, illustrating exemplary embodiments.

BRIEF DESCRIPTION OF THE DRAWINGS

The disclosure may be understood by reference to the following description of embodiments together with the accompanying drawings:

FIG. 8 is a table, labeled Table 2, illustrating the firing and skipping order of the cylinders in various intermittent firing patterns;

FIG. 9 is a table, labeled Table 3, illustrating the firing and skipping order of the cylinders when the intermittent combustion mode with each target is started from the point of time in which a first cylinder is fired;

FIG. 10 is a table, labeled Table 5, illustrating the manner in which the intermittent combustion mode is executed at different cylinder ratios;

FIG. 11 is a table, labeled Table 6, illustrating examples of various intermittent firing patterns;

FIG. 12 is a table, labeled Table 8, illustrating the manner in which the intermittent combustion mode is executed in various fired cylinder ratios;

FIG. 13 is a table, labeled Table 9, illustrating the manner of the intermittent combustion mode is executed in a fifth embodiment of this invention; and FIG. 14 is a table, labeled Table 10, illustrating the firing and skipping order of the cylinders in three different intermittent firing patterns.

DETAILED DESCRIPTION OF EMBODIMENTS

First Embodiment

Hereinafter, a method for operating an engine in an intermittent combustion mode and an engine control device according to a first embodiment will be described with reference to FIGS. 1 to 5.

Figure 1:
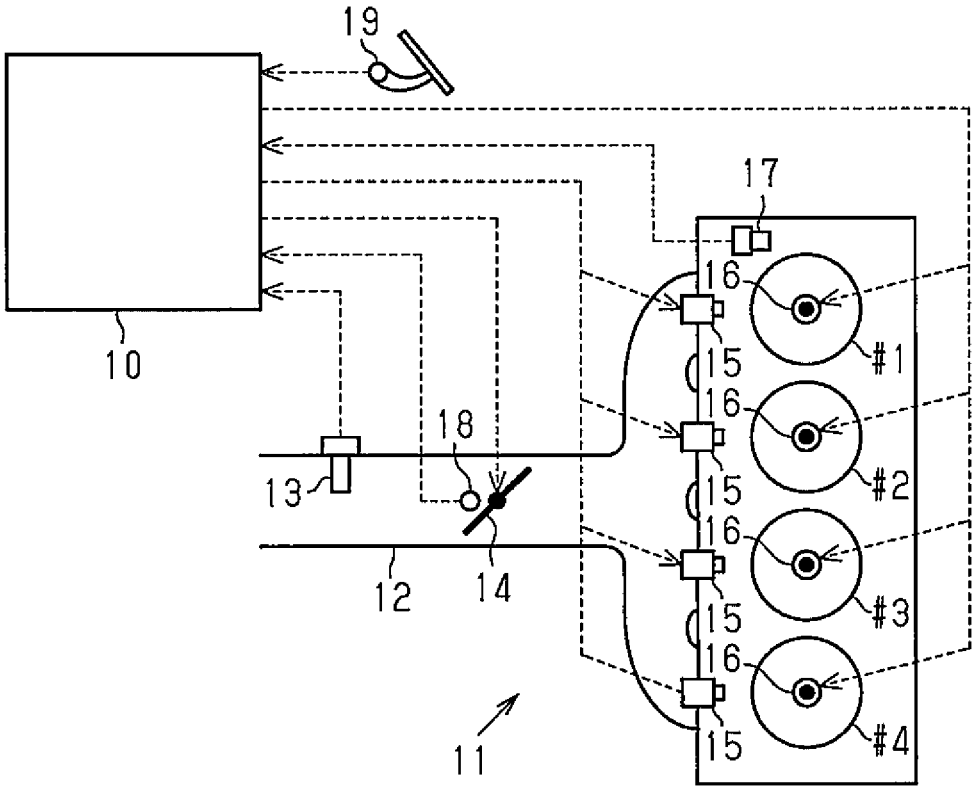
FIG. 1 is a schematic diagram of an engine to which an engine control device according to a first embodiment of the present disclosure is applied.

As shown in FIG. 1, an engine 11 includes four cylinders #1 to #4 arranged in a line. The ignition order of the cylinders #1 to #4 is in the order of the cylinder #1, the cylinder #3, the cylinder #4, and the cylinder #2. The engine 11 includes an intake passage 12, in which an air flowmeter 13 is provided. The air flowmeter 13 detects the flow rate (intake air amount GA) of intake air that flows inside the intake passage 12. The intake passage 12 is also provided with a throttle valve 14, which is a flow rate control valve for adjusting the intake air amount GA. Furthermore, the engine 11 includes injectors 15 and ignition plugs 16, which are provided for respective cylinders. The air-fuel mixture of the intake air and fuel injected from the injectors 15 is supplied to the cylinders #1 to #4 through the intake passage 12. In each of the cylinders #1 to #4, the air-fuel mixture is ignited by an electric discharge of the associated ignition plug 16 and burned.

An engine control device 10 is configured as a microcontroller for controlling the operation of the engine 11. The engine control device 10 receives detection signals from the air flowmeter 13, a crank angle sensor 17, which detects the crank angle of the engine 11, a throttle opening sensor 18, which detects the opening degree of the throttle valve 14 (throttle opening degree TA), and a gas pedal sensor 19, which detects the depression amount of the gas pedal. The engine control device 10 controls operation of the engine 11 by executing an opening degree control of the throttle valve 14, a fuel injection control of the injectors 15, and an ignition timing control of the ignition plugs 16 based on detection signals from various sensors.

The engine control device 10 obtains an engine speed NE from the change rate of the crank angle detected by the crank angle sensor 17. The engine control device 10 also obtains the required torque of the engine 11 from the depression amount of the gas pedal detected by the gas pedal sensor 19 and the engine speed NE.

The engine control device 10 performs variable control of the fired cylinder ratio γ as part of operation control of the engine 11. The fired cylinder ratio γ is the proportion of the number of the fired cylinders in the sum of the number of the cylinders that are fired (the fired cylinders) and the number of the cylinders that are skipped (the skipped cylinders). In an all-cylinder combustion mode, in which all the cylinders entering the combustion stroke are fired, the fired cylinder ratio γ is 1. In the intermittent combustion mode, in which combustion in some of the cylinders is skipped, the fired cylinder ratio γ is less than 1.

Figure 2:
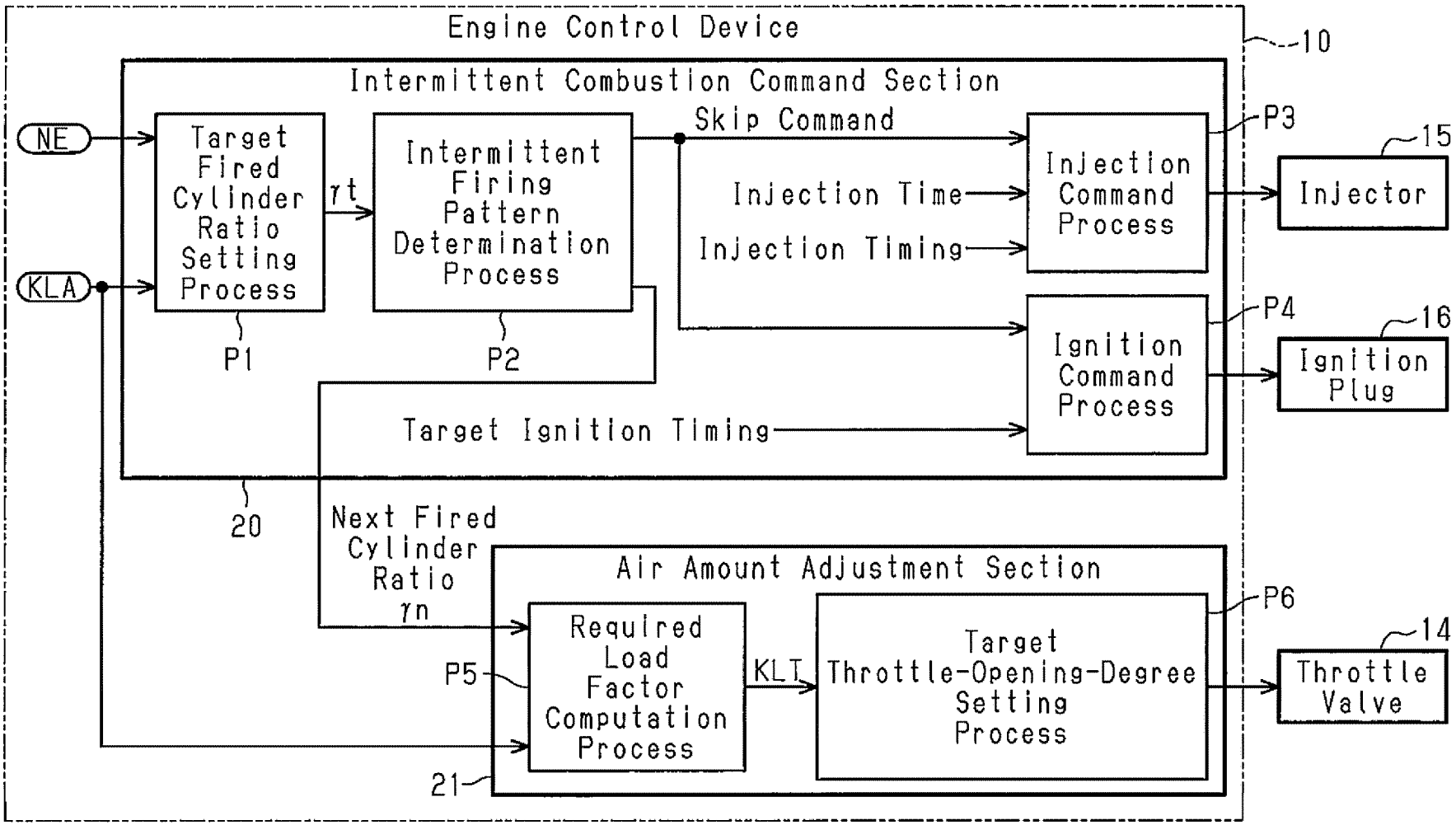
FIG. 2 is a block diagram illustrating the control structure of the engine control device.

As shown in FIG. 2, the engine control device 10 includes an intermittent combustion command section 20 and an air amount adjustment section 21 as the control structure involved in the variable control of the fired cylinder ratio γ.

The intermittent combustion command section 20 executes a target fired cylinder ratio setting process P1, an intermittent firing pattern determination process P2, an injection command process P3, and an ignition command process P4. Through these processes, the intermittent combustion command section 20 sets a target fired cylinder ratio γt and outputs injection signals and ignition signals respectively to the injectors 15 and the ignition plugs 16 of the cylinders #1 to #4 in accordance with the firing pattern determined based on the target fired cylinder ratio γt.

The air amount adjustment section 21 executes a required load factor computation process P5 and a target throttle-opening-degree setting process P6. Through these processes, the air amount adjustment section 21 adjusts an engine load factor KL in accordance with switching of the firing pattern. The engine load factor KL is the ratio of the cylinder intake air amount to the maximum cylinder intake air amount. In this case, the cylinder intake air amount is the intake air amount of one cylinder per one cycle, and the maximum cylinder intake air amount is the cylinder intake air amount when the opening degree of the throttle valve 14 is maximum.

First, the details of the processes P1 to P4 executed by the intermittent combustion command section 20 will be described.

The target fired cylinder ratio setting process P1 sets the target fired cylinder ratio γt based on the engine speed NE and an all-cylinder combustion load factor KLA. The all-cylinder combustion load factor KLA represents the engine load factor KL required to generate the required torque when the engine 11 is operated in the all-cylinder combustion mode. The value of KLA is computed based on the engine speed NE and the required torque. The target fired cylinder ratio γt is set to any of the values 1/2 (50%), 2/3 (approximately 67%), 3/4 (75%), 4/5 (80%), and 1 (100%).

Figure 3:
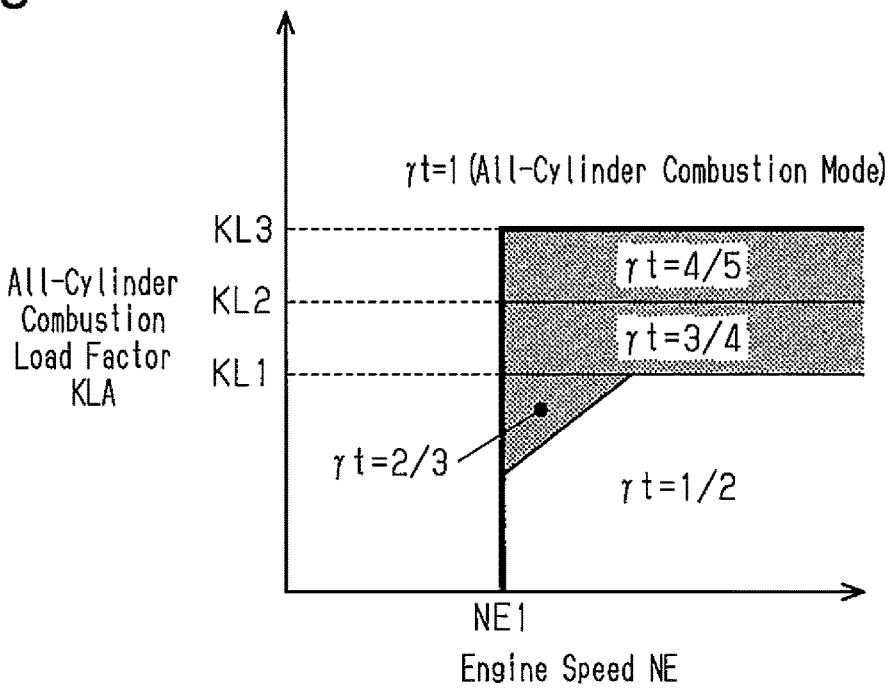
FIG. 3 is a graph illustrating the relationship between the target fired cylinder ratio, the engine speed, and the required load factor during all-cylinder combustion.

As shown in FIG. 3, in the region where the engine speed NE is less than or equal to a preset value NE1, the value of the target fired cylinder ratio γt is set to 1 regardless of the all-cylinder combustion load factor KLA.

In contrast, in the region where the engine speed NE exceeds the preset value NE1, the value of the target fired cylinder ratio γt is variably set in the range from 1/2 to 1 in accordance with the all-cylinder combustion load factor KLA. More specifically, if the all-cylinder combustion load factor KLA is greater than or equal to a preset value KL1 and less than a preset value KL2 (KL2>KL1), the target fired cylinder ratio γt is set to 3/4 (75%). If the all-cylinder combustion load factor KLA is greater than or equal to the preset value KL2 and less than a preset value KL3 (KL3>KL2), the target fired cylinder ratio γt is set to 4/5 (80%). Furthermore, if the all-cylinder combustion load factor KLA is greater than or equal to the preset value KL3, the target fired cylinder ratio γt is set to 1 (100%). As described above, in the region where the engine speed NE exceeds the preset value NE1, and the all-cylinder combustion load factor KLA is greater than or equal to the preset value KL1, the higher the all-cylinder combustion load factor KLA, the greater the value of the target fired cylinder ratio γt is set to.

In the region where the engine speed NE is greater than the preset value NE1, and the all-cylinder combustion load factor KLA is less than the preset value KL1, the target fired cylinder ratio γt is set to either the values 1/2 or 2/3. In the above-described regions, the higher the engine speed NE, the greater becomes the lower limit value of the all-cylinder combustion load factor KLA at which the value of the target fired cylinder ratio γt is set to 2/3.

In the intermittent firing pattern determination process P2, the intermittent firing pattern executed by the engine 11 is determined as shown in Table 1 in accordance with the set value of the target fired cylinder ratio γt. In the process P2, a skip command that specifies the cylinders to be skipped in the determined intermittent firing pattern is passed to the injection command process P3 and the ignition command process P4. Furthermore, in the process P2, a next fired cylinder ratio γn is passed to a required load factor computation process P5. The next fired cylinder ratio γn is the value of the fired cylinder ratio γ in the next intermittent firing pattern (hereinafter, referred to as the next firing pattern), which will be executed after the currently executed intermittent firing pattern is finished. The required load factor computation process P5 is executed by the air amount adjustment section 21.

The intermittent firing pattern in which n cylinders are successively fired, and then m cylinders are successively skipped will be represented as [n-m], where the values n and m are any natural numbers. The value of n represents the number of the fired cylinders in the intermittent firing pattern, the value of m represents the number of the skipped cylinders in the intermittent firing pattern. The firing and skipping order of the cylinders in each of the intermittent firing patterns [1-1], [2-1], [3-1], [4-1], and [5-1] is as shown in table 2 of FIG. 8.

As shown in table 1, when the value of the target fired cylinder ratio γt is set to any of 2/3, 3/4, and 4/5, the intermittent combustion mode is executed while repeating switching of the intermittent firing pattern. In contrast, when the value of the target fired cylinder ratio γt is 1/2, the intermittent firing pattern is fixed to the pattern [1-1]. In this case, the intermittent combustion mode is executed by repeating the intermittent firing pattern [1-1]. If the value of the target fired cylinder ratio γt is set to 1, the all-cylinder combustion mode is executed.

In the injection command process P3, the injection signals are output to the injectors 15 of the cylinders #1 to #4 in accordance with the injection timing and the injection time computed based on the presence/absence of the skip command and the operating state of the engine 11. More specifically, the injection signal of the injector 15 of the cylinder that has not received the skip command is turned on at the injection timing and is turned off when the injection time has elapsed from when the signal is turned on. In contrast, the injection signal of the injector 15 of the cylinder that has received the skip command is maintained off until the skip command is removed. The injection signal is a command signal that commands to fire the cylinder or to skip firing depending on whether the signal is turned on within a period of time during which injection can be performed in the cylinder entering the combustion stroke.

In the ignition command process P4, the ignition signals are output to the ignition plugs 16 of the cylinders #1 to #4 in accordance with the presence/absence of the skip command and the ignition timing computed based on the operating state of the engine 11. More specifically, the ignition signal of the ignition plug 16 of the cylinder that has not received the skip command is turned on during the time period from when current supply to the primary coil of the ignition coil (not shown) is started until when the current supply is stopped. The ignition signal of the ignition plug 16 of the cylinder that has received the skip command is maintained off until the skip command is removed. The ignition plug 16 generates spark discharge to ignite when current supply to the primary coil is stopped. The ignition signal is a command signal that commands to fire the cylinder or to skip firing depending on whether the signal is turned on within the period of time during which ignition can be performed in the cylinder entering the combustion stroke.

The intermittent combustion command section 20 executes the intermittent combustion mode or the all-cylinder combustion mode in accordance with the value of the target fired cylinder ratio γt that has been set as shown in Table 3 of FIG. 9. Table 3 shows the firing and skipping order of the cylinders when the intermittent combustion mode with each target fired cylinder ratio γt is started from the point in time when it is the #1 cylinder's turn. Subsequently, the required load factor computation process P5 and the target throttle-opening-degree setting process P6 executed by the air amount adjustment section 21 will be described in detail.

In the required load factor computation process P5, a required load factor KLT is computed in such a manner that the relationship of the required load factor KLT to the all-cylinder combustion load factor KLA and the next fired cylinder ratio γn passed from the intermittent firing pattern determination process P2 satisfies the relationship represented by an expression (1). The value of the required load factor KLT is passed from the required load factor computation process P5 to the target throttle-opening-degree setting process P6. The required load factor KLT is passed to the target throttle-opening-degree setting process P6 when the intake stroke of the last cylinder to be fired in the currently executed intermittent firing pattern is finished.

$$KLT=(KLA-KL0)\times\gamma_n+KL0 \quad (1)$$

The torque generated by the engine 11 per unit time when the all-cylinder combustion mode is executed with the all-cylinder combustion load factor KLA set as the engine load factor KL is defined as the average torque during the all-cylinder combustion. The torque generated by the engine 11 per unit time when the intermittent combustion mode is executed by repeating the intermittent firing pattern is defined as the average torque of each intermittent firing pattern. Furthermore, the value of the engine load factor KL at which the output torque of the engine 11 becomes zero is defined as a zero torque load factor KL0. The expression (1) is used to compute, as the value of the required load factor KLT, the engine load factor KL at which the average torque of the intermittent firing pattern to be executed next becomes equal to the average torque during the all-cylinder combustion.

Figure 4:
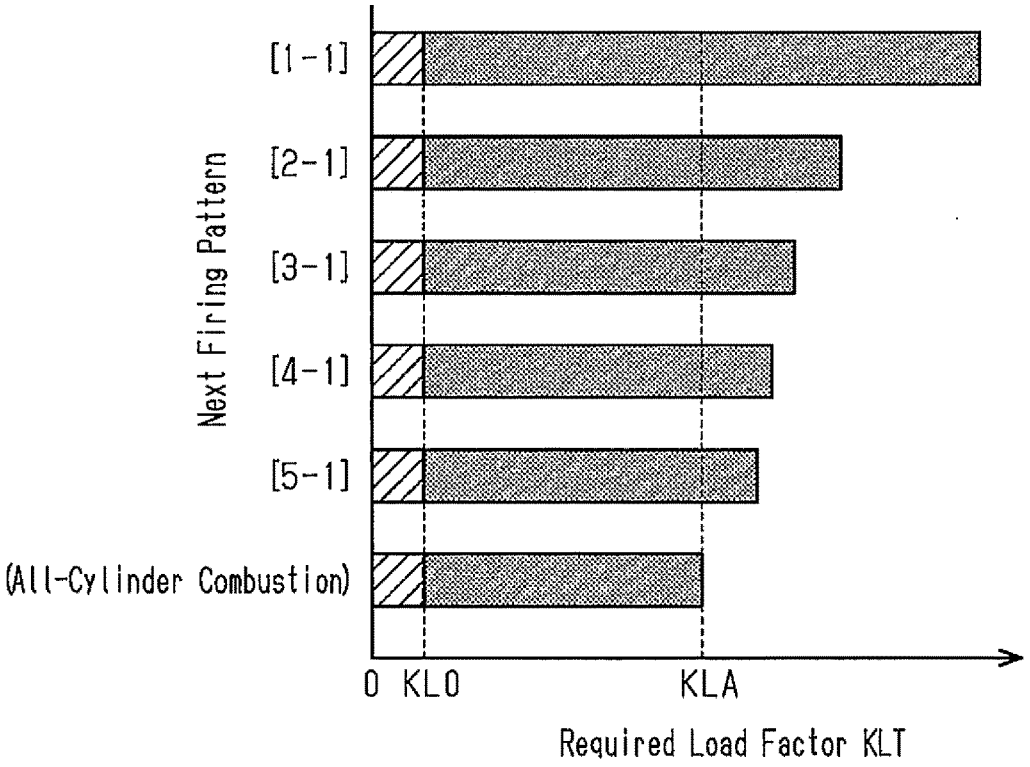
FIG. 4 is a graph illustrating the relationship between the required load factor in each of intermittent firing patterns and the required load factor during the all-cylinder combustion.

As shown in FIG. 4, the required load factor KLT exponentially increases as the number of the fired cylinders of the intermittent firing pattern is reduced. Thus, when shifting between the intermittent firing patterns [1-1] and [2-1], the engine load factor KL needs to be adjusted greatly.

In the target throttle-opening-degree setting process P6, the target throttle opening degree is calculated. The target throttle opening degree is the target value of the throttle opening degree TA required to make the engine load factor KL equal to the required load factor KLT. The calculation of the target throttle opening degree is performed using a throttle model, which is the physical model for the behavior of the intake air that passes through the throttle valve 14. The opening degree of the throttle valve 14 is controlled in accordance with the calculated target throttle opening degree.

Subsequently, operation and advantages of the method for operating the engine 11 in the intermittent combustion mode and the engine control device 10 will be described with reference to FIG. 5.

Figure 5:
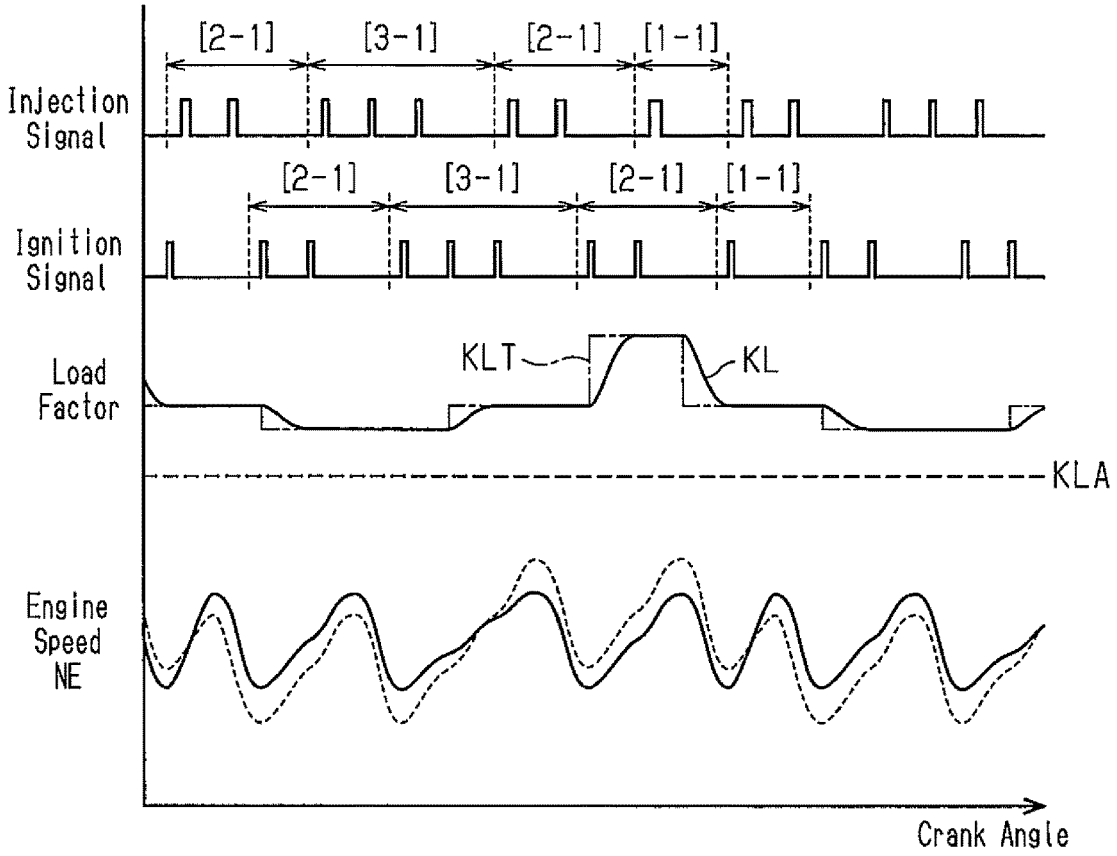
FIG. 5 is a timing chart illustrating changes in the engine load factor and the engine speed during the execution of the intermittent combustion mode with the fired cylinder ratio of 2/3.

FIG. 5 shows changes in the injection signal, the ignition signal, the required load factor KLT, the engine load factor KL, and the engine speed NE when the intermittent combustion mode is executed with the fired cylinder ratio γ of 2/3. The injection signal and the ignition signal shown in FIG. 5 are the combination of the signals independently output to the injectors 15 and the ignition plugs 16 of the cylinders #1 to #4. The broken line in FIG. 5 shows changes in the engine speed NE in a case in which the above-described intermittent combustion mode is executed in accordance with the output of the injection signals and the ignition signals performed by the intermittent combustion command section 20 without adjusting the engine load factor KL by the air amount adjustment section 21.

As described above, to obtain the fired cylinder ratio γ of 2/3, the intermittent combustion mode is executed by repeating switching of the intermittent firing pattern in the order of the patterns [2-1], [3-1], [2-1], and [1-1]. In this case, switching four times from the pattern [2-1] to the patterns [3-1], [2-1], [1-1] and back to the pattern [2-1] is defined as one cycle, and switching of the intermittent firing pattern is performed cyclically. In this case, each time the intermittent firing pattern is switched four times, the intermittent firing pattern that is the same as the previous one appears.

In this case, in accordance with switching of the intermittent firing pattern, the skipped-cylinder interval cyclically changes in the order of two cylinders, three cylinders, two cylinders, and one cylinder. Focusing independently on three intermittent firing patterns [3-1], [2-1], and [1-1] to be switched, the fired cylinder ratios γ are 3/4, 2/3, and 1/2. However, in one cycle of switching of the intermittent firing pattern, the number of the fired cylinders is eight, and the number of the skipped cylinders is four, which results in the fired cylinder ratio γ of 2/3 [8/(8+4)]. As described above, the intermittent combustion mode is executed in such a manner that the fired cylinder ratio γ becomes 2/3 while changing the skipped-cylinder interval.

During operation of the reciprocating engine, vibration having a frequency [Hz] that is an integer multiple of the engine speed [rev/sec] is generated. In particular, the problem lies in the primary vibration having the same frequency as the engine speed. The frequencies of the vibration and noise generated by the engine 11 include a specific frequency band that tends to disturb the occupant. Thus, the engine is generally designed in such a manner that the frequency of the primary vibration does not fall in the specific frequency band by setting the speed [rev/sec] higher than the upper limit value [Hz] of the specific frequency band as the idle speed. That is, the generation of vibration and noise in the specific frequency band is avoided by preventing the occurrence of torque fluctuation at a frequency lower than the frequency of the primary vibration.

In a case in which the same intermittent firing pattern is repeated, that is, in a case in which the intermittent combustion mode is executed with the fixed number of the fired cylinders and the fixed number of the skipped cylinders in the intermittent firing pattern, the torque fluctuation caused by the intermittent firing and skipping is generated in a constant cycle. If such cyclic torque fluctuation occurs, vibration and noise having low frequencies that tend to disturb the occupant are likely to occur.

For example, it is assumed that the intermittent combustion mode is executed with the fired cylinder ratio γ of 2/3 by repeating the intermittent firing pattern [2-1]. In this case, the torque fluctuation caused by skipping cylinders occurs in a constant cycle. The frequency [Hz] of the torque fluctuation is 2/3 times the engine speed NE [rev/sec] and is lower than the frequency of the primary vibration.

In contrast, in the first embodiment, the skipped-cylinder interval is changed in accordance with the switching of the intermittent firing pattern, and the cycle of the torque fluctuation caused by skipping the cylinders is changed. Thus, the intermittent combustion mode with the fired cylinder ratio γ of 2/3 is executed without causing vibration and noise in the specific frequency band that tend to disturb the occupant.

If the intermittent firing pattern is switched under a constant engine load factor KL, the average torque of the engine 11 is changed each time the intermittent firing pattern is switched. In this case, the fluctuation of the engine speed NE is likely to increase due to the influence of the change in the average torque.

However, in the first embodiment, adjustment of the engine load factor KL is performed in accordance with the switching of the intermittent firing pattern. The adjustment of the engine load factor KL is performed in such a manner that the average torque of each of the switched intermittent firing patterns becomes constant. Thus, the fluctuation of the engine speed NE caused by switching the intermittent firing pattern is limited.

If the difference in the number of the fired cylinders between before and after the switching of the intermittent firing pattern is great, the adjustment amount of the engine load factor KL required to make the average torque constant is increased. This increases the time required for the adjustment. In this respect, in the first embodiment, switching of the intermittent firing pattern is performed in such a manner that the number of the fired cylinders is changed by one cylinder at a time. Thus, the adjustment amount of the engine load factor KL at the time of switching the intermittent firing pattern is reduced. That is, the increase in the rotational fluctuation of the engine is limited by adjusting the engine load factor KL in such a manner that the average torque of each of the switched intermittent firing patterns becomes constant.

To obtain the fired cylinder ratio γ of 3/4 or 4/5, the switching of the intermittent firing pattern and the adjustment of the engine load factor KL are performed in the same manner. Thus, in these cases also, the occurrence of vibration and noise in a frequency band that is likely to disturb the occupant and the fluctuation of the engine speed NE caused by switching the intermittent firing pattern are limited.

To obtain the fired cylinder ratio γ of 1/2, the intermittent firing pattern is fixed to the pattern [1-1], and the intermittent combustion mode is executed with a constant skipped-cylinder interval. In this case, the frequency [Hz] of the torque fluctuation caused by skipping the cylinders is equal to the frequency of the engine speed NE [rev/sec], that is, the frequency of the primary vibration. Furthermore, the intermittent combustion mode is executed with the skipped-cylinder interval set to be constant only during the high-speed operation of the engine 11 in which the engine speed NE exceeds the preset value NE1. Thus, even if the intermittent combustion mode is executed with the constant skipped-cylinder interval in the above case, vibration and noise in the specific frequency band that tend to disturb the occupant do not occur.

Second Embodiment

In the first embodiment, in the case of obtaining the fired cylinder ratio γ of 2/3, 3/4, or 4/5, the occurrence of vibration and noise in the specific frequency band that tend to disturb the occupant is suppressed by changing the skipped-cylinder interval by repeating switching of the intermittent firing pattern. The higher the engine speed NE, the higher becomes the frequency of vibration and noise generated by the torque fluctuation that occurs when the skipped-cylinder interval is constant. Thus, if the engine speed NE is higher than a certain value, vibration and noise in the specific frequency band that tend to disturb the occupant do not necessarily occur even if the skipped-cylinder interval is fixed. In the second embodiment, even in a case of obtaining the fired cylinder ratio γ of 3/4 or 4/5, the intermittent combustion mode is executed with the constant skipped-cylinder interval if the engine speed NE is higher than a constant value.

Figure 6:
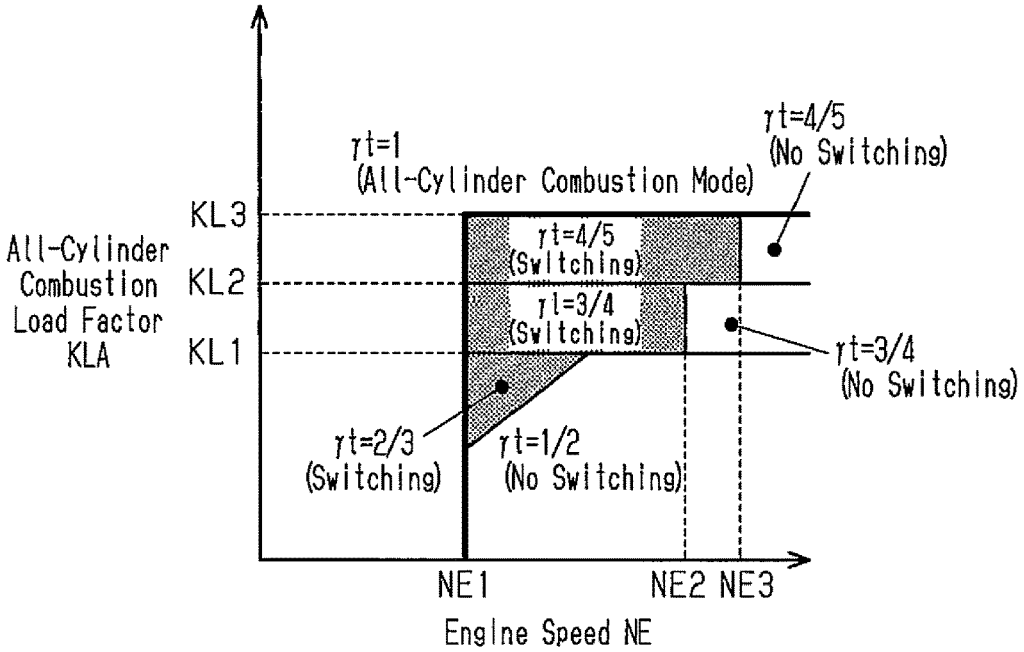
FIG. 6 is a graph illustrating the manner in which intermittent combustion control regions are set according to a second embodiment of the present disclosure.

As shown in FIG. 6, the value of the target fired cylinder ratio γt is set in the same manner as in the first embodiment. That is, the value of the target fired cylinder ratio γt is set to 3/4 when the engine speed NE is greater than or equal to the preset value NE1, and the all-cylinder combustion load factor KLA is greater than or equal to the preset value KL1 and less than the preset value KL2. The value of the target fired cylinder ratio γt is set to 4/5 when the engine speed NE is greater than or equal to the preset value NE1, and the all-cylinder combustion load factor KLA is greater than or equal to the preset value KL2 and less than the preset value KL3.

In a case in which the value of the target fired cylinder ratio γt is set to 3/4, if the engine speed NE is less than or equal to a preset threshold value NE2 (NE2>NE1), the intermittent combustion mode is executed while switching the intermittent firing pattern in the same manner as in the first embodiment. In this case, the intermittent combustion mode is executed by repeating switching of the intermittent firing pattern in the order of the patterns [3-1], [4-1], [3-1], and [2-1]. That is, switching four times from the pattern [3-1] to the patterns [4-1], [3-1], [2-1], and back to the pattern [3-1] is defined as one cycle, and switching of the intermittent firing pattern is cyclically performed. At this time, each time the intermittent firing pattern is switched four times, the intermittent firing pattern that is the same as the previous intermittent firing pattern appears.

In the case in which the value of the target fired cylinder ratio γt is set to 3/4, if the engine speed NE exceeds the threshold value NE2, the intermittent combustion mode is executed with the skipped-cylinder interval set to be constant. In this case, the intermittent combustion mode is executed by repeating the intermittent firing pattern [3-1].

In a case in which the value of the target fired cylinder ratio γt is set to 4/5, if the engine speed NE is less than or equal to a preset threshold value NE3 (NE3>NE2), the intermittent combustion mode is executed while switching the intermittent firing pattern as in the first embodiment. In this case, the intermittent combustion mode is executed by repeating switching of the intermittent firing pattern in the order of the patterns [4-1], [5-1], [4-1], and [3-1]. That is, switching four times from the pattern [3-1] to the patterns [4-1], [3-1], [2-1], and back to the pattern [3-1] is defined as one cycle, and switching of the intermittent firing pattern is cyclically performed. At this time, each time the intermittent firing pattern is switched four times, the intermittent firing pattern that is the same as the previous intermittent firing patter appears.

In the case in which the value of the target fired cylinder ratio γt is set to 4/5, if the engine speed NE exceeds the threshold value NE3, the intermittent combustion mode is executed with the skipped-cylinder interval set to be constant. In this case, the intermittent combustion mode is executed by repeating the intermittent firing pattern of the pattern [4-1].

The engine speed that does not cause vibration and noise having low frequencies that tend to disturb the occupant varies depending on the fired cylinder ratio of the engine. Thus, the above-described threshold value is desirably set as a value that varies in accordance with the firing cylinder ratio of the engine.

Third Embodiment

In the above-described embodiment, the fired cylinder ratio γ is changed in five stages including 1/2, 2/3, 3/4, 4/5, and 1. In contrast, the intermittent combustion mode may be executed by repeating switching of the intermittent firing patterns shown in Table 4 to obtain the fired cylinder ratio γ of an intermediate value between two consecutive fired cylinder ratios among the above-described fired cylinder ratios. The intermediate value includes 3/5, 5/7, 7/9, and 9/11.

TABLE 4

| FiredCylinder Ratio γ | Switching of Intermittent Firing Pattern |
|---|---|
| 3/5 (=60%) | [1-1]⇒[2-1]⇒ . . . |
| 5/7 (≈71%) | [2-1]⇒[3-1]⇒ . . . |
| 7/9 (≈78%) | [3-1]⇒[4-1]⇒ . . . |
| 9/11 (≈82%) | [4-1]⇒[5-1]⇒ . . . |

Table 5 of FIG. 10 shows the manner in which the intermittent combustion mode is executed with the fired cylinder ratio γ of 3/5, 5/7, 7/9, and 9/11. As shown in Table 5, in these cases also, the skipped-cylinder interval is changed by one cylinder each time the intermittent firing pattern is switched. This eliminates the vibration that is caused by the torque fluctuation due to skipping of the cylinders and is included in the specific frequency band that tends to disturb the occupant.

The adjustment of the engine load factor KL by the air amount adjustment section 21 in accordance with the switching of the intermittent firing pattern may be applied in these cases also. This limits an increase in the fluctuation of the engine speed NE caused by switching of the intermittent firing pattern.

Fourth Embodiment

In the above-described embodiment, the fired cylinder ratio γ is variable in the range greater than or equal to 1/2. In contrast, it is possible to execute the intermittent combustion mode to obtain a value less than 1/2 for the fired cylinder ratio γ by repeating the intermittent firing pattern [1-M], in which after one cylinder is fired, combustion in M cylinders is skipped and M is a natural number greater than or equal to 2. Table 6 of FIG. 11 shows three patterns [1-2], [1-3], and [1-4] as examples of the intermittent firing patterns.

If the interval between fired cylinders (the number of the skipped cylinders between a fired cylinder and the next fired cylinder) is constant, torque fluctuation occurs cyclically. Thus, during low-speed operation of the engine 11, vibration and noise in the specific frequency band that tend to disturb the occupant may possibly occur due to cyclic torque fluctuation.

In this respect, the intermittent combustion mode may be executed by repeating switching of the intermittent firing patterns shown in Table 7. In this case, it is possible to set the interval between fired cylinders to be uneven and to execute the intermittent combustion mode with the fired cylinder ratio γ of 2/5, 1/3, 2/7, and 1/4.

TABLE 7

| Fired Cylinder Ratio γ | Switching of Intermittent Firing Pattern |
|---|---|
| 2/5 (≈40%) | [1-2]⇒[1-1]⇒ . . . |
| 1/3 (≈33%) | [1-2]⇒[1-1]⇒[1-2]⇒[1-3]⇒ . . . |
| 2/7 (≈29%) | [1-3]⇒[1-2]⇒ . . . |
| 1/4 (≈25%) | [1-3]⇒[1-2]⇒[1-3]⇒[1-4]⇒ . . . |

Table 8 of FIG. 12 shows the manner in which the intermittent combustion mode is executed with the above-described fired cylinder ratios γ. In the case shown in Table 7, each time the intermittent firing pattern is switched, the interval between fired cylinders is changed by one cylinder at a time. This eliminates the vibration that is caused by the torque fluctuation due to skipping of the cylinders and is included in the specific frequency band that tends to disturb the occupant.

Figure 7:
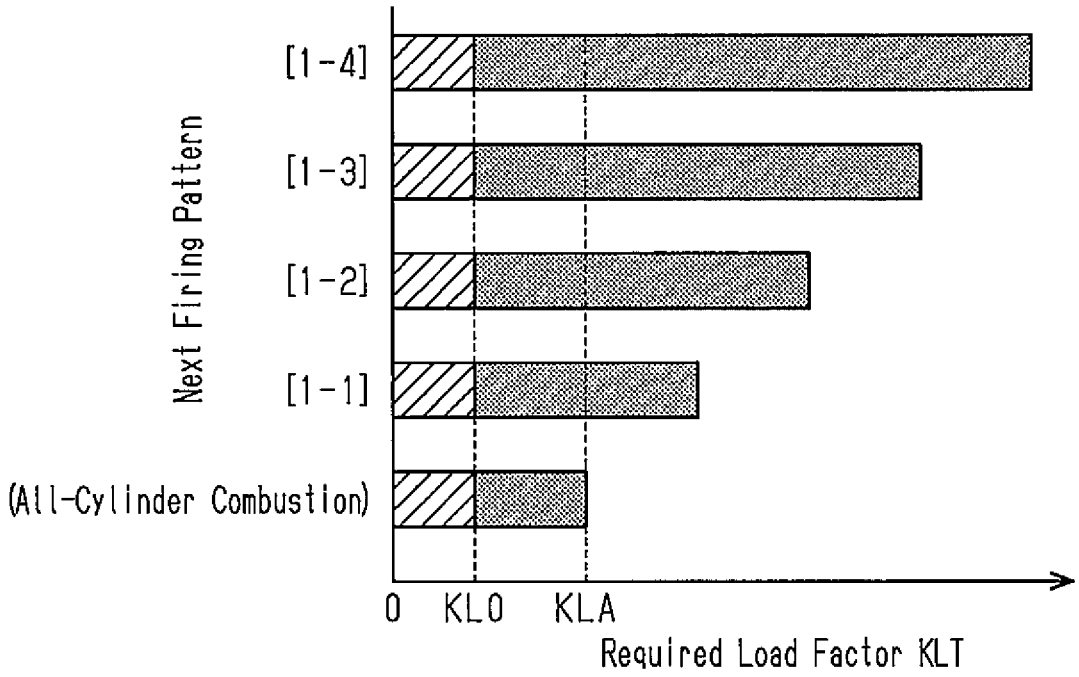
FIG. 7 is a graph illustrating the relationship between the required load factor in each of intermittent firing patterns and the required load factor during the all-cylinder combustion according to a fourth embodiment of the present disclosure.

In this case also, when switching of the above-described intermittent firing pattern is performed with the constant engine load factor KL, the average torque of the engine 11 is changed each time the intermittent firing pattern is switched, increasing the fluctuation of the engine speed NE. The adjustment of the engine load factor KL by the air amount adjustment section 21 can be applied to the switching of the intermittent firing pattern in the above case. This limits an increase in the fluctuation of the engine speed NE caused by switching of the intermittent firing pattern. FIG. 7 shows the relationship between the required load factor KLT of each intermittent firing pattern at this time and the all-cylinder combustion load factor KLA.

Fifth Embodiment

In the above-described embodiment, the intermittent combustion mode with the fired cylinder ratio γ of 1/2 repeats the intermittent firing pattern [1-1]. In this case, every other cylinder is skipped, causing torque fluctuation cyclically. Thus, when the engine speed NE is low, the torque fluctuation may possibly cause vibration in a frequency band that tends to disturb the occupant.

In contrast, the intermittent combustion mode may be executed by repeating switching of the intermittent firing pattern in the order of the patterns [1-1], [2-1], [1-1], and [1-2]. That is, switching of the intermittent firing pattern may be cyclically performed in such a manner that each time the intermittent firing pattern is switched four times, the intermittent firing pattern that is the same as the previous intermittent firing pattern appears. In this case, switching four times from the pattern [1-1] to the patterns [2-1], [1-1], [1-2], and back to the pattern [1-1] is defined as one cycle.

Table 9 of FIG. 13 shows the manner in which the intermittent combustion mode is executed at this time. In this case, the intermittent combustion mode with the fired cylinder ratio γ of 1/2 can be executed while varying the cycle of the torque fluctuation. Thus, the region in which the intermittent combustion mode with the fired cylinder ratio γ of 1/2 can be executed is expanded to the lower speed region.

Sixth Embodiment

In the third embodiment, two different intermittent firing patterns [1-1] and [2-1], in which the number of the skipped cylinder is both 1 and the number of the fired cylinders differs by only 1, are alternately switched to achieve the fired cylinder ratio γ of 3/5. The fired cylinder ratio γ of 3/5 can be achieved by performing the two different intermittent firing patterns in the order of the patterns [1-1], [2-1], [1-1], [1-1], [2-1], and [2-1]. In this case, switching of the intermittent firing pattern four times including switching from the pattern [1-1] to the pattern [2-1], repeating the pattern [1-1] twice, repeating the pattern [2-1] twice, and switching back to the pattern [1-1] is defined as one cycle. In this manner, switching of the intermittent firing pattern is performed cyclically in such a manner that each time the intermittent firing pattern is switched four times, the intermittent firing pattern that is the same as the previous intermittent firing pattern appears. Additionally, switching of the intermittent firing pattern is performed in such a manner that the fired cylinder ratio γ in one cycle becomes 3/5.

In this case also, since the number of the fired cylinders is changed each time the intermittent firing pattern is switched, cyclic torque fluctuation is limited, and vibration and noise having low frequencies that tend to disturb the occupant are unlikely to occur. Furthermore, since the number of the fired cylinders or the number of the skipped cylinders is changed only by one cylinder each time the intermittent firing pattern is switched, the increase in the rotational fluctuation of the engine is also limited.

It is also possible to execute the intermittent combustion mode with the fired cylinder ratio γ other than 3/5 by performing switching of the intermittent firing pattern including a period in which the same intermittent firing pattern appears consecutively. For example, the fired cylinder ratio γ of 2/5 can be achieved by performing two different intermittent firing patterns [1-2] and [1-1] in the order of the patterns [1-2], [1-1], [1-2], [1-2], [1-1], and [1-1]. In this case also, switching four times including switching from the pattern [1-2] to the pattern [1-1], repeating the pattern [1-2] twice, repeating the pattern [1-1] twice, and switching back to the pattern [1-2] is defined as one cycle of switching of the intermittent firing pattern. In this manner, switching of the intermittent firing pattern is cyclically executed in such a manner that each time the intermittent firing pattern is switched four times, the intermittent firing pattern that is the same as the previous intermittent firing pattern appears. Additionally, switching of the intermittent firing pattern is performed in such a manner that the fired cylinder ratio γ in one cycle becomes 2/5.

Seventh Embodiment

Furthermore, the fired cylinder ratio γ of 3/5 can also be achieved by switching between three different intermittent firing patterns [2-2], [3-2], and [4-2] in which the number of the skipped cylinders is two, and the number of the fired cylinders differs by 1 as shown in Table 10 of FIG. 14. That is, the fired cylinder ratio γ of 3/5 is obtained by repeating switching of the intermittent firing pattern in the order of the patterns [3-2], [2-2], [3-2], and [4-2]. In this case, switching of the intermittent firing pattern is performed cyclically in such a manner that the intermittent firing pattern that is the same as the previous intermittent firing pattern appears each time the intermittent firing pattern is switched four times. Switching four times from the pattern [3-2] to the patterns [2-2], [3-2], [4-2], and back to the pattern [3-2] is defined as one cycle.

In this case also, since the number of the fired cylinders is changed each time the intermittent firing pattern is switched, cyclic torque fluctuation is limited, and vibration and noise having low frequencies that tend to disturb the occupant are unlikely to occur. Furthermore, since the number of the fired cylinders or the number of the skipped cylinders is changed only by one cylinder each time the intermittent firing pattern is switched, the increase in the rotational fluctuation of the engine is also limited.

Supplementary Explanation 1

Various manners for switching the intermittent firing pattern are presented in the above-described embodiments. All the presented manners for switching the intermittent firing pattern can be generalized as follows.

The intermittent firing pattern in which n cylinders are successively fired and then m cylinders are successively skipped will be represented as [n−m], where the values n and m are natural numbers. Hereinafter, the number of the cylinders n that are successively fired is defined as the number of the fired cylinders, and the number of the cylinders m that are successively skipped is defined as the number of the skipped cylinders.

The intermittent firing pattern that is at the beginning of the switching order of the intermittent firing pattern will be referred to as a first firing pattern. The number of the fired cylinders of the first firing pattern is referred to as n1, and the number of the skipped cylinders of the first firing pattern is referred to as m1. The values of the number of the fired cylinders and the number of the skipped cylinders are natural numbers. That is, the first firing pattern is the intermittent firing pattern that successively fires n1 cylinders and then successively skips combustion in m1 cylinders, where the values n1 and m1 are natural numbers.

Next, the intermittent firing pattern in which one of the number of the fired cylinders n and the number of the skipped cylinders m has the same value as in the first firing pattern, and in which the difference obtained by subtracting the number of the skipped cylinders m from the number of the fired cylinders n is greater than that in the case in the first firing pattern by 1 is defined as a second firing pattern. The intermittent firing pattern in which the value of one of the number of the fired cylinders n and the number of the skipped cylinders m has the same value as in the first firing pattern, and in which the difference obtained by subtracting the number of the skipped cylinders m from the number of the fired cylinders n is less than the case in the first firing pattern by 1 is defined as a third firing pattern.

Switching of the three different intermittent firing patterns (refer to Table 1) with the fired cylinder ratio γ of 2/3, 3/4, and 4/5 as illustrated in the first embodiment includes switching of the three different intermittent firing patterns, in which the value of the number of the skipped cylinders m is all 1, but the value of the number of the fired cylinders n differs by 1, in the following order. That is, the switching of the three different intermittent firing patterns is performed in the order of (1) the first firing pattern, (2) the intermittent firing pattern in which the number of the fired cylinders n is greater than that in the first firing pattern by 1, (3) the intermittent firing pattern that is the same as the first firing pattern, and (4) the intermittent firing pattern in which the number of the fired cylinders n is less than that in the first firing pattern by 1. The intermittent firing pattern (2) satisfies the requirements of the second firing pattern, and the intermittent firing pattern (4) satisfies the requirements of the third firing pattern. In other words, in the switching of the intermittent firing pattern illustrated in the first embodiment, a period in which the intermittent combustion mode is executed with the first firing pattern, a period in which the intermittent combustion mode is executed with the second firing pattern, a period in which the intermittent combustion mode is executed with the first firing pattern, and a period in which the intermittent combustion mode is executed with the third firing pattern appear in this order. In this case, the period in which the intermittent combustion mode is executed with the first firing pattern and the period in which the intermittent combustion mode is executed with either the second firing pattern or the third firing pattern alternately appear.

The switching of the four different intermittent firing patterns illustrated in the third embodiment (refer to Table 4) includes switching of the intermittent firing pattern [n−1] in which the value of the number of the skipped cylinders m is 1. The switching is performed in the order of (1) the first firing pattern and (2) the intermittent firing pattern in which the number of the fired cylinders n is greater than that in the first firing pattern by only 1. At this time, the intermittent firing pattern (2) satisfies the requirements of the second firing pattern. That is, in the switching of the intermittent firing patterns illustrated in the third embodiment, the period in which the intermittent combustion mode is executed with the first firing pattern and the period in which the intermittent combustion mode is executed with the second firing pattern alternately appear.

The fourth embodiment illustrates the intermittent firing pattern [1−n] in which the value of the number of the fired cylinders n is 1 and the manner in which the following two different intermittent firing patterns are switched.

In one case, when the fired cylinder ratio γ is 1/3 or 1/4 as shown in Table 7, the intermittent firing pattern is switched in the order of (1) the first firing pattern, (2) the intermittent firing pattern in which the number of the skipped cylinders m is less than that in the first firing pattern by 1, (3) the intermittent firing pattern that is the same as the first firing pattern, and (4) the intermittent firing pattern in which the number of the skipped cylinders m is greater than that in the first firing pattern by 1. At this time, the intermittent firing pattern (2) satisfies the requirements of the second firing pattern, and the intermittent firing pattern (4) satisfies the requirements of the third firing pattern. That is, the period in which the intermittent combustion mode is executed with the first firing pattern, the period in which the intermittent combustion mode is executed with the second firing pattern, the period in which the intermittent combustion mode is executed with the first firing pattern, and the period in which the intermittent combustion mode is executed with the third firing pattern appear in this order.

In another case, when the fired cylinder ratio γ is 2/5 or 2/7 as shown in Table 7, the intermittent firing pattern is switched in such a manner that (1) the first firing pattern and (2) the intermittent firing pattern in which the number of the skipped cylinders m is less than that in the first firing pattern by 1 alternately appear. At this time, the intermittent firing pattern (2) satisfies the requirements of the second firing pattern. Thus, in the switching of the intermittent firing pattern, in this case, the period in which the intermittent combustion mode is executed with the first firing pattern and the period in which the intermittent combustion mode is executed with the second firing pattern alternately appear.

The fifth embodiment presents switching of the intermittent firing pattern in the order of the patterns [1-1], [2-1], [1-1], and [1-2]. With reference to the first firing pattern in this case, which is the intermittent firing pattern [1-1], the pattern [2-1] satisfies the requirements of the second firing pattern, and the pattern [1-2] satisfies the requirements of the third firing pattern. That is, in the switching of the intermittent firing pattern, the period in which the intermittent combustion mode is executed with the first firing pattern, the period in which the intermittent combustion mode is executed with the second firing pattern, the period in which the intermittent combustion mode is executed with the first firing pattern, and the period in which the intermittent combustion mode is executed with the third firing pattern appear in this order.

Furthermore, in the switching of the intermittent firing pattern with the fired cylinder ratio γ of 3/5 according to the sixth embodiment, the period in which the intermittent combustion mode is executed with the intermittent firing pattern [1-1], and the period in which the intermittent combustion mode is executed with the intermittent firing pattern [2-1] alternately appear. In this case, the pattern [2-1] is the intermittent firing pattern that satisfies the requirements of the second firing pattern when the pattern [1-1] is the first firing pattern. Likewise, in the switching of the intermittent firing pattern with the fired cylinder ratio γ of 2/5 according to the sixth embodiment, the period in which the intermittent combustion mode is executed with the intermittent firing pattern [1-1], and the period in which the intermittent combustion mode is executed with the intermittent firing pattern [1-2] alternately appear. In this case, the intermittent firing pattern [1-2] satisfies the requirements of the third firing pattern when the pattern [1-1] is the first firing pattern.

The seventh embodiment shows that the fired cylinder ratio γ of 2/3 is achieved by repeating switching of the intermittent firing pattern in the order of the patterns [3-2], [4-2], [3-2], and [2-2]. In this case, if the pattern [3-2] is the first firing pattern, the pattern [4-2] satisfies the requirements of the second firing pattern, and the pattern [2-2] satisfies the requirements of the third firing pattern.

Switching of the intermittent firing pattern according to the above-described embodiments is categorized as either a category (A) or a category (B).

(A) The intermittent firing pattern is switched in such a manner that the periods in which the intermittent combustion mode is executed with each firing pattern appear in the order of the period in which the intermittent combustion mode is executed with the first firing pattern, the period in which the intermittent combustion mode is executed with the second firing pattern, the period in which the intermittent combustion mode is executed with the first firing pattern, and the period in which the intermittent combustion mode is executed with the third firing pattern.

(B) The intermittent firing patterns are switched in such a manner that the periods in which the intermittent combustion mode is executed with each firing pattern appear in the order of the period in which the intermittent combustion mode is executed with the first firing pattern and the period in which the intermittent combustion mode is executed with the second firing pattern.

Furthermore, in the category (A), every other period is the period in which the intermittent combustion mode is executed with the first firing pattern appears. Additionally, after the period in which the intermittent combustion mode is executed with the first firing pattern, either the period in which the intermittent combustion mode is executed with the second firing pattern or the period in which the intermittent combustion mode is executed with the third firing pattern appears. Therefore, in the switching of the intermittent firing patterns presented in the above-described embodiments, the period in which the intermittent combustion mode is executed with the first firing pattern and the period in which the intermittent combustion mode is executed with either the second firing pattern or the third firing pattern alternately appear.

The switching of the intermittent firing patterns illustrated in the first to fifth embodiments and the seventh embodiment is performed at each intermittent firing pattern. That is, switching of the intermittent firing pattern is performed in such a manner that there is no period in which the same intermittent firing pattern appears consecutively in one cycle of switching.

In contrast, switching of the intermittent firing pattern illustrated in the sixth embodiment includes the period in which the same intermittent firing pattern is repeated to be performed twice. That is, the switching of the intermittent firing pattern according to the sixth embodiment includes the period in which the same intermittent firing pattern appears consecutively, the period in which the same intermittent firing pattern does not appear consecutively, and the period in which the intermittent firing patterns in which one of n and m is changed from the value of the immediately preceding intermittent firing pattern by only 1 appear consecutively.

If the intermittent combustion mode is executed while switching the intermittent firing pattern in such a manner, the generation cycle of the torque fluctuation caused by firing and skipping changes in accordance with the switching of the intermittent firing pattern. This eliminates the vibration that is caused by the torque fluctuation and is included in a frequency band that tends to disturb the occupant. Since changes in the interval between the fired/skipped cylinders at each switching of the intermittent firing pattern are set to the minimum of one cylinder, an increase in the rotational fluctuation of the engine 11 due to the switching of the intermittent firing pattern is limited.

Furthermore, even in a case in which switching of the intermittent firing pattern is performed in a manner other than those illustrated in the above-described embodiments, if the period in which the intermittent combustion mode is executed with the first firing pattern and the period in which the intermittent combustion mode is executed with either the second firing pattern or the third firing pattern alternately appear, the number of the fired cylinders or the number of the skipped cylinders is changed each time the intermittent firing pattern is switched. This suppresses the occurrence of the cyclic torque fluctuation. Either the number of the fired cylinders or the number of the skipped cylinders is changed by only one cylinder each time the intermittent firing pattern is switched. Thus, the rotational fluctuation of the engine 11 caused by switching of the intermittent firing pattern is limited. For this reason, if switching of the intermittent firing pattern is performed in the above-described manner, vibration and noise having low frequencies that tend to disturb the occupant are not caused, and the increase in the rotational fluctuation of the engine 11 is limited.

The output pattern of the injection signals and the ignition signals when the intermittent firing pattern [n−m] is executed includes successively commanding firing of n cylinders and then successively commanding skipping of combustion in m cylinders. The output pattern of the injection signals and the ignition signals during execution of the first firing pattern, the second firing pattern, and the third firing pattern are respectively defined as a first output pattern, a second output pattern, and a third output pattern. The second output pattern in this case includes an output pattern of command signals in which the value of either the number of the fired cylinders n or the number of the skipped cylinders m is the same as that in the first output pattern, and in which the difference obtained by subtracting the number of the skipped cylinders m from the number of the fired cylinders n is greater than that in the first output pattern by 1. The third output pattern includes an output pattern of command signals in which the value of either the number of the fired cylinders n or the number of the skipped cylinders m is the same as that in the first output pattern, and in which the difference obtained by subtracting the number of the skipped cylinders m from the number of the fired cylinders n is less than that in the first output pattern by 1. Thus, the intermittent combustion command section 20 of the engine control device that employs the method for operating an engine in the intermittent combustion mode according to each of the above-described embodiments outputs command signals while switching the output patterns in such a manner that the period in which the command signal is output with the first output pattern and the period in which the command signal is output with either the second output pattern or the third output pattern alternately appear.

Supplementary Explanation 2

Subsequently, the adjustment of the engine load factor KL performed by the air amount adjustment section 21 in the above-described embodiments will further be described.

The air amount adjustment section 21 adjusts the engine load factor KL in such a manner that the engine load factor KL becomes equal to the required load factor KLT computed based on the expression (1) during switching of the intermittent firing pattern. The engine load factor before the adjustment is referred to as KL1, and the engine load factor after the adjustment is referred to as KL2.

Furthermore, the fired cylinder ratio of the intermittent firing pattern before the switching is referred to as γ1, and the fired cylinder ratio of the intermittent firing pattern after the switching is referred to as γ2. The operational expressions of KL1 and KL2, which are the expressions (2) and (3), are obtained from the expression (1).

$$KL1=(KLA-KL0)\times\gamma 1+KL0 \quad (2)$$

$$KL2=(KLA-KL0)\times\gamma 2+KL0 \quad (3)$$

If there is no change in the all-cylinder combustion load factor KLA before and after the switching of the intermittent firing pattern, KL1 and KL2 satisfy the relationship represented by an expression (4).

$$\frac{(KL1-KL0)}{\gamma 1}+KL0=\frac{(KL2-KL0)}{\gamma 2}+KL0 \quad (4)$$

The fired cylinder ratio γ of the intermittent firing pattern [n−m] is represented by n/(n+m). Thus, the adjustment of the engine load factor KL during switching of the intermittent firing pattern in the above-described embodiments is performed in such a manner that the values of (KL−KL0)×(n+m)/n+KL0 before and after the switching of the intermittent firing pattern are the same.

As described above, to suppress the fluctuation of the engine speed NE caused by the switching of the intermittent firing pattern, the engine load factor KL is desirably adjusted until the average torque after the switching becomes equal to the average torque before the switching. However, for example, due to the responsiveness of the throttle valve 14, there might be a case in which the engine load factor KL cannot be adjusted until the average torque after the switching becomes equal to the average torque before the switching. In this case also, as long as the difference in the value of the values of (KL−KL0)×(n+m)/n+KL0 between before and after the switching is decreased, the change in the average torque caused by the switching is reduced compared with a case in which the adjustment is not performed. Thus, the configuration is effective to a certain degree in limiting the fluctuation of the engine speed NE.

Furthermore, if the object is only to reduce vibration and noise in the specific frequency band during the intermittent combustion mode, the engine load factor KL during switching of the intermittent firing pattern does not necessarily have to be adjusted. In this case, the air amount adjustment section 21 is omitted from the engine control device 10 shown in FIG. 2.

The above-described embodiments may be modified as follows.

In each of the above-described embodiments, the intermittent firing pattern is switched among two or three different intermittent firing patterns. However, the intermittent firing patterns may be switched among four or more different intermittent firing patterns. For example, the intermittent combustion mode with the fired cylinder ratio γ of 3/4 can be executed by repeating switching of the intermittent firing pattern in the order of the patterns [3-1], [4-1], [5-1], [4-1], [3-1], [2-1], [1-1], and [2-1]. In this case, switching eight times from the pattern [3-1] to the patterns [4-1], [5-1] . . . [1-1], [2-1], and back to the pattern [3-1] is defined as one cycle, and the switching of the intermittent firing pattern is cyclically performed. That is, each time the intermittent firing pattern is switched eight times, the intermittent firing pattern that is the same as the previous intermittent firing pattern appears. In this manner, one of the number of the fired cylinders n and the number of the skipped cylinders m is set to the same value as that before switching the intermittent firing pattern, and the other one of the number of the fired cylinders n and the number of the skipped cylinders m is changed by only 1 from that before switching the intermittent firing pattern. Furthermore, switching of the intermittent firing pattern is cyclically executed in such a manner that the intermittent firing pattern that is the same as the previous intermittent firing pattern appears each time the intermittent firing pattern is switched a predetermined number of times. Additionally, switching of the intermittent firing pattern is performed in such a manner that the fired cylinder ratio in one cycle of switching of the intermittent firing pattern becomes equal to the target fired cylinder ratio. With this configuration, the number of the fired cylinders or the number of the skipped cylinders is changed each time the intermittent firing pattern is switched, suppressing the occurrence of cyclic torque fluctuation. Furthermore, only one of the number of the fired cylinders and the number of the skipped cylinders is changed by only one cylinder each time the intermittent firing pattern is switched. Thus, the rotational fluctuation of the engine caused by the switching of the intermittent firing pattern is also limited.

In each of the above-described embodiments, combustion in each cylinder is skipped by stopping the fuel injection and ignition. If the configuration is applied to an engine in which a valve lock mechanism, which stops opening of intake/exhaust valves is provided in each cylinder, the method for operating the engine in the intermittent combustion mode and the engine control device can be configured to skip firing in the cylinders by stopping the opening operation of the intake/exhaust valves using the valve lock mechanism. In this case, a signal that commands the valve lock mechanism of each cylinder to permit/stop the opening operation of the intake/exhaust valves serves as the command signal that commands whether to fire or skip firing in the cylinder that is entering the combustion stroke.

The method for operating the engine in the intermittent combustion mode and the engine control device according to each of the above-described embodiments can be applied to an engine other than the inline 4-cylinder engine 11 in the same manner. In this case, the order of the cylinder numbers in Table 3, Table 5, Table 8, and Table 9 correspond to the ignition order of the engine to which the configuration is applied. For example, in a case of a V6 engine in which the ignition order is #1, #2, #3, #4, #5, and #6, the order of the cylinder numbers in Table 3, Table 5, Table 8, and Table 9 will be #1, #2, #3, #4, #5, #6, #1, . . . .

Therefore, the present examples and embodiments are to be considered as illustrative and not restrictive and the disclosure is not to be limited to the examples and embodiments given herein.

The invention claimed is:

1. A method for operating an engine in an intermittent combustion mode in such a manner that a fired cylinder ratio of an engine becomes equal to a target fired cylinder ratio set based on an operating state of the engine by repeating an intermittent firing pattern in which n cylinders are successively fired, and then m cylinders are successively skipped, where n and m are variables of natural numbers, the method comprising:

switching the intermittent firing pattern in such a manner that one of n and m is set to a value equal to the value before switching the intermittent firing pattern, the other one of n and m is changed by only 1 from the value before switching the intermittent firing pattern, the switching of the intermittent firing pattern is performed cyclically so that, each time the switching of the intermittent firing pattern is performed a predetermined number of times, the intermittent firing pattern that is the same as the previous intermittent firing pattern appears, and the fired cylinder ratio in one cycle of switching of the intermittent firing pattern becomes equal to the target fired cylinder ratio.

2. The method for operating an engine in an intermittent combustion mode according to claim 1, wherein one cycle of switching of the intermittent firing pattern includes no period in which an identical intermittent firing pattern appears consecutively.

3. The method for operating an engine in an intermittent combustion mode according to claim 1, wherein one cycle of switching of the intermittent firing pattern includes a period in which an identical intermittent firing pattern appears consecutively and a period in which an intermittent firing pattern appears consecutively in which one of n and m is changed by only 1 from an immediately preceding intermittent firing pattern.

4. The method for operating an engine in an intermittent combustion mode according to claim 1, wherein in the intermittent firing pattern, n is the number of fired cylinders, and m is the number of skipped cylinders, an intermittent firing pattern in which the number of the fired cylinders is a natural number n1, and the number of the skipped cylinders is a natural number m1 is defined as a first firing pattern, an intermittent firing pattern in which the value of either one of the number of the fired cylinders and the number of the skipped cylinders is equal to the value in the first firing pattern, and in which a difference obtained by subtracting the number of the skipped cylinders from the number of the fired cylinders is greater than the value in the case of the first firing pattern by 1 is defined as a second firing pattern, an intermittent firing pattern in which the value of either one of the number of the fired cylinders and the number of the skipped cylinders is equal to the value in the first firing pattern, and in which a difference obtained by subtracting the number of the skipped cylinders from the number of the fired cylinders is less than the value in the case of the first firing pattern by 1 is defined as a third firing pattern, and a period in which the intermittent combustion mode is executed with the first firing pattern and a period in which the intermittent combustion mode is executed with either one of the second firing pattern and the third firing pattern alternately appear.

5. The method for operating an engine in an intermittent combustion mode according to claim 4, wherein a period in which the intermittent combustion mode is executed with the first firing pattern, a period in which the intermittent combustion mode is executed with the second firing pattern, a period in which the intermittent combustion mode is executed with the first firing pattern, and a period in which the intermittent combustion mode is executed with the third firing pattern appear in this order.

6. The method for operating an engine in an intermittent combustion mode according to claim 5, wherein the switching of the intermittent firing pattern is performed on condition that an engine speed is less than or equal to a preset threshold value, and the intermittent combustion mode is executed by repeating the first firing pattern if the engine speed exceeds the threshold value.

7. The method for operating an engine in an intermittent combustion mode according to claim 6, wherein the threshold value is a value that changes in accordance with the value of the target fired cylinder ratio.

8. The method for operating an engine in an intermittent combustion mode according to claim 1, wherein an intake air amount of one cylinder per one cycle is defined as a cylinder intake air amount, the cylinder intake air amount when a throttle opening degree is maximum is defined as a maximum cylinder intake air amount, a ratio of the cylinder intake air amount to the maximum cylinder intake air amount is defined as an engine load factor, which is represented by KL, a value of the engine load factor at which an output torque of the engine is zero is represented by KL0, and the method comprises adjusting the engine load factor so as to reduce a difference in a value of (KL−KL0)×(n+ m)/n+KL0 between before and after the switching of the intermittent firing patterns.

9. An engine control device, comprising:

a target fired-cylinder-ratio setting section, which sets a target fired cylinder ratio based on an operating state of an engine; and an intermittent combustion command section, which outputs a command signal that commands whether to fire or skip cylinders that are entering a combustion stroke, wherein the intermittent combustion command section outputs the command signal by repeating an output pattern in which the combustion command section commands to successively fire n cylinders and then commands to successively skip firing in m cylinders, where n and m are variables of natural numbers, wherein the intermittent combustion command section switches the intermittent firing pattern in such a manner that one of n and m is set to a value equal to the value before switching the intermittent firing pattern, the other one of n and m is changed by only 1 from the value before switching the intermittent firing pattern, the switching of the output pattern is performed cyclically so that, each time the switching of the output pattern is performed a predetermined number of times, the output pattern that is the same as the previous output pattern appears, and a fired cylinder ratio in one cycle of switching of the output pattern becomes equal to the target fired cylinder ratio.

10. The engine control device according to claim 9, wherein the intermittent combustion command section switches the output pattern in such a manner that one cycle of switching of the output pattern includes no period in which an identical output pattern appears consecutively.

11. The engine control device according to claim 9, wherein the intermittent combustion command section switches the output pattern in such a manner that one cycle of switching of the output pattern includes a period in which an identical output pattern appears consecutively and a period in which an output patterns appears consecutively in which one of n and m is changed by only 1 from an value in the immediately preceding output pattern.

12. The engine control device according to claim 9, wherein in the output pattern, n is the number of the fired cylinders, and m is the number of the skipped cylinders, an output pattern of the command signal in which the number of the fired cylinders is a natural number n1 and the number of the skipped cylinders is a natural number m1 is defined as a first output pattern, an output pattern of the command signal in which the value of either one of the number of the fired cylinders and the number of the skipped cylinders is equal to the value in the first output pattern, and in a difference obtained by subtracting the number of the skipped cylinders from the number of the fired cylinders is greater than the value in the case of the first output pattern by 1 is defined as a second output pattern, an output pattern of the command signal in which the value of either one of the number of the fired cylinders and the number of the skipped cylinders is equal to the value in the first output pattern, and in which a difference obtained by subtracting the number of the skipped cylinders from the number of the fired cylinders is less than the value in the case of the first output pattern by 1 is defined as a third output pattern, and the intermittent combustion command section switches the output pattern in such a manner that a period in which the command signal is output with the first output pattern and a period in which the command signal is output with either one of the second output pattern and the third output pattern alternately appear.

13. The engine control device according to claim 12, wherein the intermittent combustion command section switches the output pattern in such a manner that a period in which the command signal is output in the first output pattern, a period in which the command signal is output in the second output pattern, a period in which the command signal is output in the first output pattern, and a period in which the command signal is output in the third output pattern appear in this order.

14. The engine control device according to claim 13, wherein the intermittent combustion command section switches the output pattern on condition that an engine speed is less than or equal to a preset threshold value, and the intermittent combustion command section outputs the command signal to repeat the first output pattern when the engine speed exceeds the threshold value.

15. The engine control device according to claim 14, wherein the threshold value is set to a value that differs depending on the fired cylinder ratio of the engine.

16. The engine control device according to claim 9, further comprising an air amount adjustment section, wherein an intake air amount of one cylinder per one cycle is defined as a cylinder intake air amount, the cylinder intake air amount when a throttle opening degree is maximum is defined as a maximum cylinder intake air amount, a ratio of the cylinder intake air amount to the maximum cylinder intake air amount is defined as an engine load factor, which is represented by KL, a value of the engine load factor at which an output torque of the engine is zero is represented by KL0, and the air amount adjustment section adjusts the engine load factor so as to reduce a difference in a values of (KL−KL0)×(n+m)/n−KL0 between before and after the switching of the output pattern.

* * * * *